US005496109A

United States Patent [19]

Dedoes

[11] Patent Number: 5,496,109

[45] Date of Patent: Mar. 5, 1996

[54] PAINT STIRRING EQUIPMENT WITH IMPROVED IDLER WHEEL

[75] Inventor: John T. Dedoes, Brighton, Mich.

[73] Assignee: Dedoes Industries, Inc., Walled Lake, Mich.

[21] Appl. No.: 425,399

[22] Filed: Apr. 20, 1995

[51] Int. Cl.[6] ..... B01F 7/20

[52] U.S. Cl. ..... 366/198; 366/605

[58] Field of Search ..... 366/197, 198, 366/241–251, 605

[56] References Cited

U.S. PATENT DOCUMENTS

| | | | |
|---|---|---|---|
| 2,802,649 | 8/1957 | Stockton | 366/605 X |
| 3,118,653 | 1/1964 | Dedoes | 366/251 X |
| 4,225,248 | 9/1980 | Para | 366/251 |
| 4,961,657 | 10/1990 | Jingu et al. | 400/599 |
| 5,160,198 | 11/1992 | Fillon | 366/605 X |
| 5,332,310 | 7/1994 | Wells | 366/129 |

FOREIGN PATENT DOCUMENTS

| | | | |
|---|---|---|---|
| 2102417 | 4/1972 | France | 366/198 |
| 858607 | 12/1952 | Germany | 366/197 |
| 2203059 | 10/1988 | United Kingdom | 366/605 |

*Primary Examiner*—Charles E. Cooley
*Attorney, Agent, or Firm*—Gifford, Krass, Groh, Sprinkle, Patmore, Anderson & Citkowski

[57] ABSTRACT

Automatic paint stirring equipment of the type having a rack adapted to removably receive and support a plurality of paint cans in which each paint can includes a cover having a paint stirring assembly mounted to the cover with a paddle inside the can and a driven member positioned above the cover. A plurality of drive assemblies are also provided wherein each drive assembly includes a drive shaft rotatably mounted to the rack and having a drive member secured to a lower end of the drive shaft which mechanically drivably engages the driven member on the paint can cover. A pulley is secured to the other end of the drive shaft while a flexible endless belt is positioned around the pulley as well as the output from a motor. The paint stirring equipment includes an improved idler wheel having a cylindrical outer surface and which is constructed of a plastic material. One idler wheel is secured to the rack between every other drive pulley so that an outer surface of the idler wheel engages and tensions the endless belt.

5 Claims, 1 Drawing Sheet

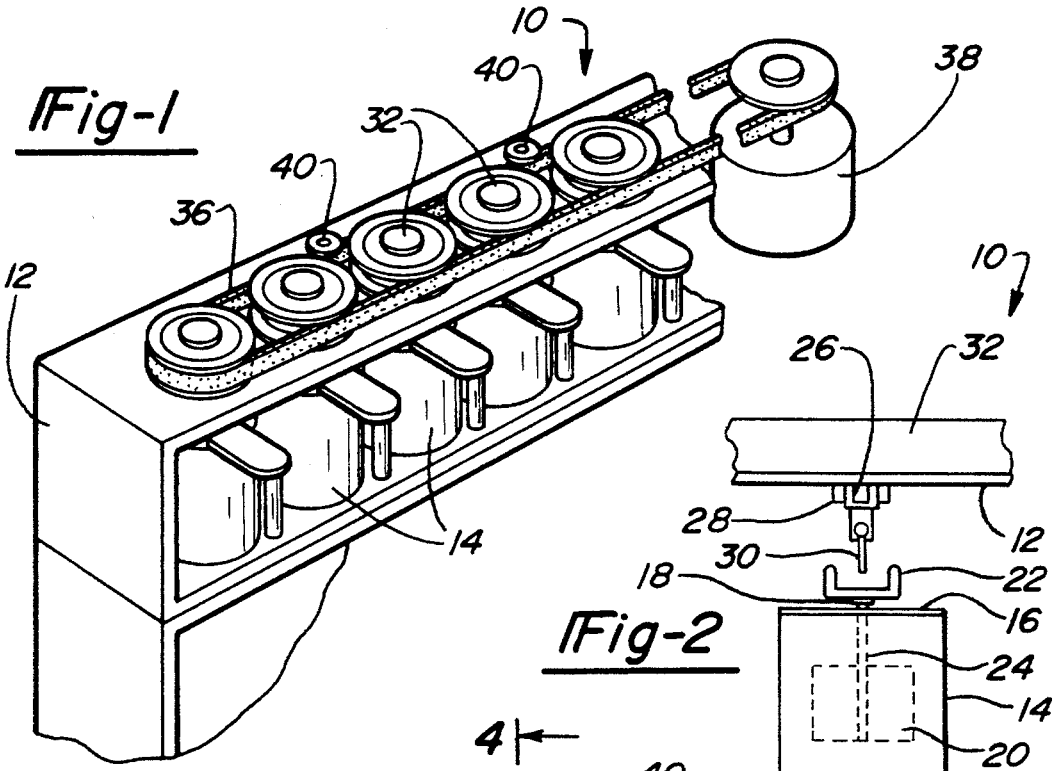
Fig-1
Fig-2
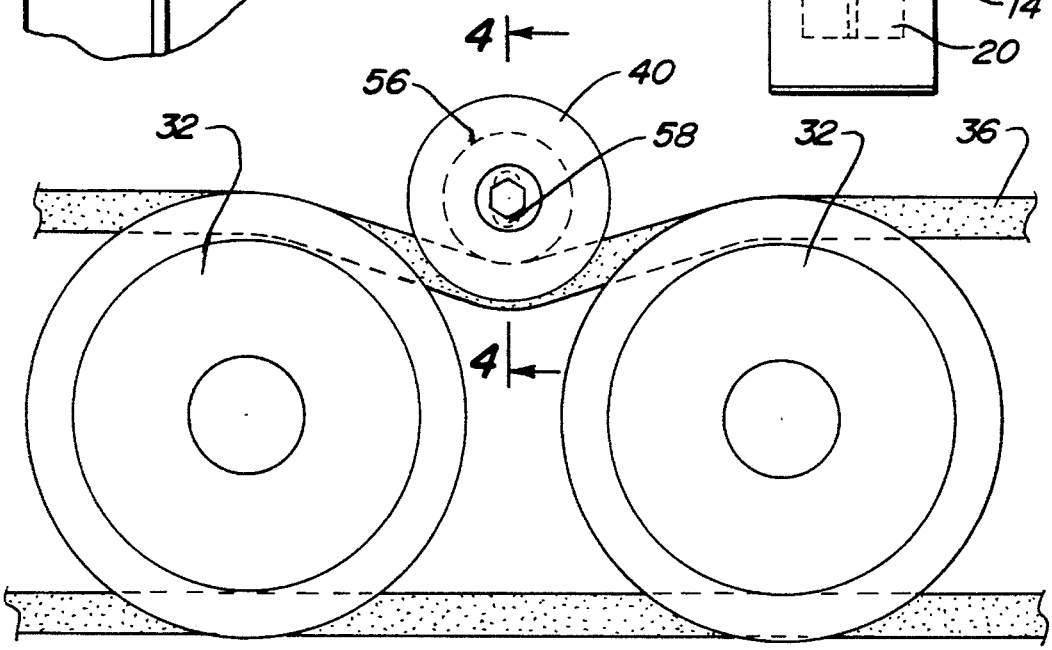
Fig-3
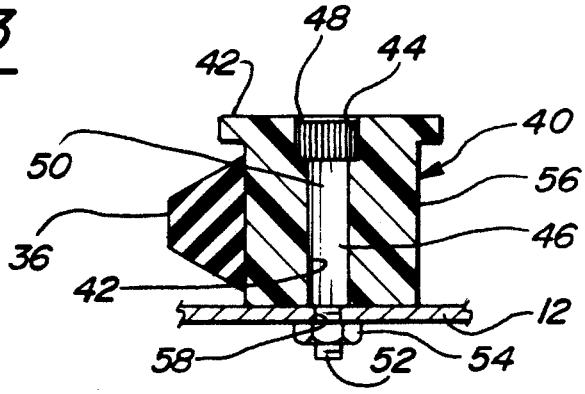
Fig-4

PAINT STIRRING EQUIPMENT WITH IMPROVED IDLER WHEEL

BACKGROUND OF THE INVENTION

I. Field of the Invention

The present invention relates generally to automatic paint stirring equipment and, more particularly, to an improved idler wheel assembly for such automatic paint stirring equipment.

II. Description of the Prior Art

There are many types of previously known automatic paint stirring equipment of the type commonly used in automotive repair shops. The previously known automatic paint stirring equipment typically comprises a rack designed to removably receive and support a plurality of cans of paint.

A cover assembly is disposed across the open top of each paint can. Each cover assembly, furthermore, includes a stirring mechanism with a paddle positioned inside the paint can, a driven member positioned above the cover and a shaft which connects the driven member to the paddle. Furthermore, upon insertion of the paint can with its cover in the rack, a drive member mounted to the rack automatically mechanically engages the driven member on the paint can cover. Thus, rotation of the drive member simultaneously rotates the driven member and its attached paddle thus stirring the paint in the desired fashion.

These previously known drive mechanisms typically comprise a drive shaft which is rotatably mounted to the rack and has a first or lower end positioned adjacent the driven member on the paint can cover (when the paint can is inserted into the rack) as well as an upper end. A drive member is secured to the lower end of the drive shaft for mechanically engaging the driven member of the stirring assembly on the paint can cover. Conversely, a pulley is secured to the upper end of the drive shaft so that a number of pulleys are generally coplanar but spaced apart and aligned with each other.

In order to rotatably drive the pulleys, and thus rotatably drive the paddle of the stirring mechanism in the desired fashion, a flexible belt is disposed around the drive pulleys as well as the output from a motor. Thus, activation of the motor rotatably drives the pulleys.

In order to ensure that the pulleys are mechanically driven by the motor, these previously known devices have included idler wheels which are mounted to the rack adjacent the drive pulleys. These idler wheels tension the belt and ensure that the belt rotatably drives the pulleys.

These previously known idler wheels, however, have not proven entirely satisfactory in operation. One disadvantage of these previously known devices is that they were typically ball bearing mounted idler wheels which were secured to the rack. As such, the idler wheels were relatively expensive to manufacture and install.

A still further disadvantage of these previously known idler wheels is that they required periodic maintenance, e.g. lubrication, in order to prevent malfunction of the pulley. Similarly, even if the idler wheels were maintained, failure of the ball bearings within the idler wheels would necessitate the entire replacement of the idler wheel.

SUMMARY OF THE PRESENT INVENTION

The present invention provides an automatic paint stirring equipment with an improved idler wheel design.

In brief, the automatic paint stirring equipment of the present invention comprises a rack adapted to removably receive and support a plurality of paint cans. Each can includes a cover with a stirring assembly mounted to the cover. The paint stirring assembly includes a paddle positioned within the interior of the paint can, a driven member positioned above the cover and a shaft which connects the driven member to the paddle.

A plurality of drive assemblies are also mounted to the rack so that one drive assembly is adapted to stir the paint in one paint can when positioned within the rack. Each drive assembly includes a drive shaft rotatably mounted to the rack and having a drive member secured to its lower end. This drive member is mechanically drivingly connected to the driven member of the cover once the paint can is positioned within the rack.

A drive pulley is secured to the opposite or upper end of each drive shaft so that the drive pulleys are generally spaced from, coplanar and aligned with each other. A flexible endless belt is then disposed around the pulleys as well as the output from a motor so that, upon activation of the motor, the motor drives the drive pulleys.

In order to maintain sufficient tension on the flexible belt to ensure a driving connection between the flexible belt and the drive pulley, a plurality of idler wheels are provided. Each idler wheel is generally cylindrical in shape and is constructed of a plastic material. The idler wheel is secured to the rack between every other drive pulley so that an outer surface of the outer pulley engages and tensions the flexible belt.

Each idler wheel is preferably constructed of an oil impregnated plastic material thereby eliminating all maintenance on the idler wheel assembly. Furthermore, since the idler wheel can be molded, it is inexpensive to construct as well as to install in the rack.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a fragmentary elevational view illustrating a portion of the preferred embodiment of the present invention;

FIG. 2 is a fragmentary diagrammatic view illustrating a portion of the preferred embodiment of the present invention;

FIG. 3 is a fragmentary top view illustrating the preferred embodiment of the present invention; and FIG. 4 is a sectional view taken substantially along line 4—4 in FIG. 3.

DETAILED DESCRIPTION OF A PREFERRED EMBODIMENT OF THE PRESENT INVENTION

With reference first to FIGS. 1 and 2, a preferred embodiment of the paint stirring equipment 10 of the present invention is thereshown and comprises a rack 12 adapted to removably receive and support a plurality of paint cans 14 in a side-by-side relationship.

A cover 16 is provided across the open top of each paint can 14. As best shown in FIG. 2, each cover assembly 16 includes a stirring assembly 18 having a paddle 20 positioned within the interior of the can 14, a driven member 22 positioned above the cover 16 and means, such as a shaft 24, for connecting the driven member 22 and paddle 20 together.

As best shown in FIG. 2, a plurality of drive shafts 26 (only one illustrated) are rotatably mounted by a bushing 28 to the rack 12 so that the drive shafts 26 are spaced apart from each other. Furthermore, a drive member 30 is secured to a lower end of the drive shaft 26 such that, with the paint can 14 positioned within the rack 12, the drive member 30 and driven member 22 are mechanically connected together.

With reference now to FIGS. 1–3, a drive pulley 32 is secured to the upper or other end of each drive shaft 26. As best shown in FIG. 1, the pulleys 32 are generally coplanar with each other but spaced apart and in alignment with each other.

With reference now to FIGS. 1 and 3, in order to drive the pulleys 32, and thus the paddles 20 contained within the various paint cans 14, an endless flexible belt 36 is provided around all of the drive pulleys 32 as well as the output from a conventional motor 38 (FIG. 1).

In order to ensure adequate frictional engagement between the belt 36 and the individual drive pulleys 32, an idler wheel 40 is provided between every other drive pulley 32 (see FIG. 1). Each idler wheel 40 is generally cylindrical in shape with an enlarged diameter rim 42 at one end. An axial throughbore 42 having an enlarged diameter countersink 44 at one end is also provided through each idler wheel 40.

With reference now particularly to FIG. 4, a shoulder bolt 46 is provided for securing each idler wheel 40 to the rack 12. The shoulder bolt 46 includes a cylindrical shank 50 having an enlarged diameter head 48 at one end and a reduced diameter threaded portion 52 at its opposite end. The shank portion 50 of the shoulder bolt 46 is dimensioned so that it is freely slidably received within the idler wheel bore 42 and has an axial length just slightly greater than the axial length of the bore 42. Consequently, with the shoulder bolt 46 positioned through the bore 42 as shown in FIG. 4 and secured in place by a nut 54, the idler wheel 40 freely rotates about the shoulder bolt 46.

As best shown in FIGS. 3 and 4, the idler wheel 40 is secured to the frame 12 such that an outer cylindrical surface 56 of the idler wheel contacts the belt 36 between two drive pulleys 32. Furthermore, the threaded end 52 of the shoulder bolt 46 is positioned within an oblong slot 58 having its longitudinal axis extending perpendicular to the belt 36 so that the tension on the belt 36 provided by the idler wheel 40 can be adjusted by adjusting the position of the idler wheel 40 before tightening the nut 54. The width of the oblong slot 58, however, is less than the diameter of the shoulder belt shank 50 so that, upon tightening of the nut 54, the rack 12 is sandwiched in between the end of the shank 50 and the nut 54.

The idler wheel 40 is preferably of a one-piece plastic construction. Preferably, the idler wheel in constructed from an oil impregnated plastic to minimize friction between the idler wheel 40 and the shoulder bolt 46.

From the foregoing, it can be seen that the present invention provides automatic paint stirring equipment with an improved idler wheel assembly. In particular, since the previously known ball bearings have been completely eliminated in the idler wheel, maintenance as well as possible failure of the idler wheel is essentially eliminated.

Having described my invention, however, many modifications thereto will become apparent to those skilled in the art to which it pertains without deviation from the spirit of the invention as defined by the scope of the appended claims.

I claim:

1. Automatic paint stirring equipment comprising a rack adapted to removably receive and support a plurality of paint cans, each paint can having a cover and a paint stirring assembly mounted to the cover, said paint stirring assembly having a paddle positioned within the paint can and a driven member positioned above the cover and mechanically connected to the paddle, a plurality of drive assemblies, each drive assembly having a drive shaft rotatably mounted to the rack, a drive member secured to one end of said drive shaft which is mechanically drivingly connected to the driven member of the cover of one paint can positioned in the rack, a plurality of drive pulleys, one drive pulley being secured to the other end of each drive shaft, a motor, a belt for drivingly connecting said motor to said drive pulleys, a plurality of idler wheels, each said idler wheel having a cylindrical outer surface, each said idler wheel being constructed of a plastic material, means for mounting said idler wheels to said rack so that said outer surface of one idler wheel abuts against said belt between every other drive pulley wherein each idler wheel includes an axial throughbore and wherein said idler wheel mounting means comprises a shoulder bolt extending through said axial throughbore and an opening in said rack, and a nut for securing each shoulder bolt to said rack.

2. The invention as defined in claim 1 wherein said opening in said rack is oblong in shape.

3. The invention as defined in claim 2 wherein an elongated dimension of said oblong opening extends substantially perpendicular to said belt.

4. The invention as defined in claim 1 where each said idler wheel comprises an oil impregnated plastic material.

5. The invention as defined in claim 1 wherein each said idler wheel includes an enlarged diameter rim about one end of each said idler wheel.

* * * * *

UNITED STATES PATENT AND TRADEMARK OFFICE

CERTIFICATE OF CORRECTION

PATENT NO. : 5,496,109

DATED : March 5, 1996

INVENTOR(S) : John T. Dedoes

It is certified that error appears in the above-indentified patent and that said Letters Patent is hereby corrected as shown below:

Column 2, line 30, after "the" (first occurrence), delete "outer".

Column 3, line 50, delete "shoulder belt";

line 55, delete "in" and insert --is--.

Signed and Sealed this

Twenty-ninth Day of October 1996

*Attest:*

Bruce Lehman

BRUCE LEHMAN

*Attesting Officer*

*Commissioner of Patents and Trademarks*